US005474321A

United States Patent [19]

Pritz

[11] Patent Number: 5,474,321

[45] Date of Patent: Dec. 12, 1995

[54] CARRYING PLATE FOR SECURING A SKI BOOT ON A SKI

[75] Inventor: Kurt Pritz, Tamsweg, Austria

[73] Assignee: Marker Deutschland GmbH, Germany

[21] Appl. No.: 250,448

[22] Filed: May 27, 1994

[30] Foreign Application Priority Data

May 27, 1993 [DE] Germany ..... 43 17 675.5

[51] Int. Cl.[6] ..... A68C 5/06

[52] U.S. Cl. ..... 280/607; 280/602; 280/617

[58] Field of Search ..... 280/601, 602, 280/607, 617, 618, 636

[56] References Cited

U.S. PATENT DOCUMENTS

| | | | |
|---|---|---|---|
| 3,797,839 | 3/1974 | Smolka et al. | 280/607 X |
| 3,797,844 | 3/1974 | Smolka et al. | 280/607 X |
| 4,067,593 | 1/1978 | Earl | 280/607 X |
| 4,294,460 | 10/1981 | Kirsch | 280/607 |
| 4,678,200 | 7/1987 | Powell | 280/607 |
| 4,896,895 | 1/1990 | Bettosini | 280/607 |
| 5,344,176 | 9/1994 | Trimble | 280/607 X |
| 5,393,086 | 2/1995 | LeMasson et al. | 280/607 X |
| 5,431,427 | 7/1995 | Pieber et al. | 280/607 |

FOREIGN PATENT DOCUMENTS

| | | |
|---|---|---|
| 0035343A1 | 9/1981 | European Pat. Off. . |
| 0183586A1 | 6/1986 | European Pat. Off. . |
| 0230989 | 1/1987 | European Pat. Off. . |
| 0490043A1 | 6/1992 | European Pat. Off. . |
| 0498053A1 | 8/1992 | European Pat. Off. . |
| 2135450 | 4/1972 | Germany . |
| 2134810 | 7/1974 | Germany . |
| 8705563 U | 8/1987 | Germany . |
| 4041046A1 | 6/1991 | Germany . |
| 4100327A1 | 7/1991 | Germany . |
| 4112299A1 | 12/1991 | Germany . |
| 674155A5 | 5/1990 | Switzerland . |
| WO83/03360 | 10/1983 | WIPO . |
| WO91/10485 | 7/1991 | WIPO . |

*Primary Examiner*—Margaret A. Focarino
*Assistant Examiner*—Michael Mar
*Attorney, Agent, or Firm*—D. Peter Hochberg; Mark Kusner; Michael Jaffe

[57] ABSTRACT

A carrying plate having a fastening portion for connecting the carrying plate to a ski in at least three zones that are located one beside the other in the longitudinal direction of the ski. The carrying plate is connectable to the ski in the at least three zones in a torsionally fixed manner with respect to the longitudinal, transverse and vertical axes of the ski zones, is connectable to the ski in the at least three zones in a non-compliant manner in the transverse and vertical directions of the ski, and is connectable to the ski in only one of the at least three zones in a non-compliant manner in the longitudinal direction of the ski.

25 Claims, 2 Drawing Sheets

CARRYING PLATE FOR SECURING A SKI BOOT ON A SKI

FIELD OF THE INVENTION

The invention relates to a carrying plate which serves to secure a ski boot on a ski, is rigid in comparison with the ski, is arranged at a distance above the top side of the ski and is connected or can be connected non-displaceably to the ski in a region which is supported on the ski and which, in the longitudinal direction of the ski, is of considerably shorter length than the ski boot.

BACKGROUND OF THE INVENTION

When a ski boot is fixed, in the conventional manner, both at the boot toe and at the boot heel by (releasable) binding parts which are arranged directly on the top side of the ski, then the binding part at the heel can usually move in the longitudinal direction of the ski counter to a so-called thrust springing mechanism. This is intended, on the one hand, to ensure that the binding parts bear on the boot in a play-free manner. On the other hand, it is intended to avoid the ski boot sole, non-compliant to the greatest extent, being able to cause excessive rigidity in the central zone of the ski when running over bumps and the like.

Nevertheless, it is unavoidable that the bending characteristic of the ski is changed. Furthermore, the release characteristic of the binding parts when the ski is bent in one direction or another is also inevitably changed.

In order to eliminate these difficulties, DE-C 21 34 810 has already made provision for the ski to be equipped with carrying plates of the type specified in the introduction in order to secure the ski boot, the connection between ski and carrying plate being configured such that the carrying plate can pivot, about a transverse axis, relative to the ski counter to a low degree of resistance. Although, in this known arrangement, the bending capacity of the ski remains unchanged to the greatest extent, the control of the ski is rendered more difficult.

The same also applies for the carrying plates which are disclosed in European Patent No. 02 03 989 and DE-U 87 05 563 and are connected to the ski at their front and rear ends by means of lever linkages, arranged in the form of a parallelogram, and are supported on the ski in their central region by a spring or damping arrangement.

Disclosed in CH-A 674 155 and DE-A 41 12 299 are carrying plates which are supported on the ski fixedly in their central region and, by their front and rear regions, via compliant damping material. In this case too, ski control has proved to be impaired.

Disclosed in the documents WO 83/03 360, WO 91/10 485, DE-A 40 41 046, DE-A 41 00 327 and EP-A 04 98 053 are various ski-binding carriers which essentially comprise a relatively flexible plate which, at its front and rear ends, may be connected to the ski fixedly or displaceably in the longitudinal direction of the ski and, between its ends, is supported on the ski by a layer which is arranged between plate and ski and consists of damping material, or by strip elements consisting of damping material.

Such arrangements can indeed damp vibrations of the ski and, in this respect, contribute to stabilization of the ski at high speeds. However, once again competitive skiers complain of impairment to the controllability of the ski during maneuvers at high speed.

EP-A 01 83 586 discloses a carrying plate which serves to secure a pair of ski boots and with which a so-called monoski can be equipped. Said carrying plate is connected fixedly to the ski, beneath the toes and heels of the boots, via feet arranged thereon, it being possible to change the rigidity of the ski further, if required, by a leaf-spring part which can be fitted between the top side of the ski and the carrying plate. An elastomeric material may be arranged between the feet of the carrying plate and the top side of the ski in order to damp vibrations. Here too, the running properties of the ski are not satisfactory.

EP-A 04 90 043, finally, discloses a ski which is rigidified in the region of the ski boot by a carrying-plate part which secures the binding parts, is fixedly connected to the ski and secures additional spring lamellae, by means of which the compliance of the front and rear ski ends can be changed. Moreover, it is intended that vibrations of the ski should also be damped thereby. Here too, running properties of the ski which are appropriate for competitive sport cannot be achieved.

SUMMARY OF THE INVENTION

The object of the invention, then, is to improve considerably a carrying plate of the type specified in the introduction and the ski/carrying plates combination with regard to the controllability of the ski when skiing competitively.

This object is achieved according to the invention in that, both with a fastening zone in the center of the ski and in front of this and behind this, the supported region of the carrying plate is connected or can be connected to the ski in a torsionally fixed manner with respect to the longitudinal, transverse and vertical axes of the ski and in a virtually non-compliant manner in the transverse and vertical directions of the ski and also in a virtually non-compliant manner in the longitudinal direction of the ski within a narrow transverse strip.

In the arrangement according to the invention, the front and rear ski halves are each anchored on that region of the carrying plate which is supported on the ski, on the one hand, on the fastening zone in the center of the ski and, on the other hand, in front of this and behind this, with the result that forces acting on one ski half and which try to bend said ski half with respect to the carrying plate cannot effect direct bending of the other ski half relative to the carrying plate. At the same time it is ensured, by the compliance, which is produced outside a narrow transverse strip, of the connection of carrying plate and ski in the longitudinal direction of the ski, that the bending properties of the ski halves are not changed by the carrying plate. However, the invention takes into account the fact that, despite that region of the carrying plate which is supported on the ski being short in length in comparison with the ski boot, when the ski bends a certain capacity for longitudinal movement of the top side of the ski or of the neighboring top layer of the ski relative to the carrying plate is advantageous for good bending properties.

Owing to the arrangement, according to the invention of the carrying plate, the ski can, on the one hand, with the action of corresponding external forces, carry out movements or vibrations effecting the entire length of the ski without it being possible for said movements or vibrations to be influenced by the carrying plate to any great extent. On the other hand, the front half and the rear half of the ski form separately movable parts relative to the carrying plate, the movement of one part exerting only extremely low retroactive effects on the movement of the other part in each case.

As a rule, the supported region of the carrying plate is arranged approximately in the longitudinal center thereof, i.e., the carrying plate projects forwards and rearwards beyond the supported region in the longitudinal direction of the ski. Shifts in weight of the skier with the effect of a forward lean or backward lean are thereby transmitted, in the forwards and rearwards directions, to the greatest extent similarly and effectively onto the ski.

Moreover, it is expedient and advantageous, at least in the case of the latter arrangement of the supported region, if the transverse strip, within which the connectability or connection, which is non-compliant in the longitudinal direction of the ski, between the ski and that region of the carrying plate which is supported thereon is produced, is located approximately in the center of the ski, the center of the ski being taken to mean that region which, in accordance with the respective design of the ski, is to be located in the region of the center of the skier's foot.

In terms of a particularly good controllability of the ski at high speeds and during correspondingly high-speed maneuvers, it is particularly advantageous if the supported region of the carrying plate is connected or can be connected to the ski in a virtually undamped manner, in particular in the direction of the vertical axis of the ski. This ensures a particularly good force flux between carrying plate and ski.

Insofar as damping of movements of the ski is desired, this can be achieved by damping material, such as rubber or another elastomeric material, being arranged between the top side of the ski and the carrying-plate parts which project forwards or rearwards beyond that region of the carrying plate which is supported on the ski.

In general, it is expedient to provide only a low degree of damping, if any at all, when—as in the case of slalom—a large number of maneuvers with a small radius of curvature are to be carried out in quick succession. In contrast, the damping is increased when—as in the case of giant slalom or super giant slalom or even in purely downhill competitions—only maneuvers with a relatively large radius of curvature are to be carried out or the maneuvers are separated by relatively long periods of time or straight skiing stretches.

Irrespective of the degree of overall damping, the degree of damping acting on the front half of the ski may be different than that acting on the rear half of the ski.

For example, it may be advantageous for slalom competitions if, between the front carrying-plate region, which, in the longitudinal direction of the ski, projects forwards beyond the region supported on the ski, and the top side of the ski there is arranged a somewhat firmer elastomeric material than between the rear carrying-plate region and the rear part of the ski.

If appropriate, the different damping rates may also be achieved in that the carrying-plate parts projecting beyond that region which is supported on the ski have somewhat different lengths, with the result that only differently sized bodies of damping elastomeric material can be arranged between said carrying-plate parts and those regions of the top side of the ski which are overlapped by said parts.

In order to prevent the formation of ice between the carrying plate and the top side of the ski, the spaces remaining between ski and carrying plate may be closed off or filled, when no damping material is arranged there, by materials which do not have any damping properties of note.

In accordance with the present invention there is provided a carrying plate for securing a ski boot on a ski, wherein said carrying plate is rigid relative to said ski, is arranged at a distance above the top side of the ski, and is connectable nondisplaceably to the ski in a region which is supported on the ski. The carrying plate comprises a central portion or support means for supporting a boot holding means above the ski and for connecting said carrying plate to said ski, which in the longitudinal direction of the ski is of shorter length than the ski boot to be held on the boot holding means. The central portion comprises forward and rearward fastening sections, and an inner fastening section between said forward and rearward fastening sections, wherein said forward and rearward fastening sections and said inner fastening section are connectable to said ski in a torsionally fixed manner with respect to the longitudinal, transverse and vertical axes of said ski and in a generally non-compliant manner in the transverse and vertical directions of the ski, and said inner fastening section is also connectable to said ski in a generally non-compliant manner in the longitudinal direction of the ski.

In accordance with another aspect of the present invention there is provided a carrying plate, having a binding means, a front end portion and a rear end portion extending outward longitudinally from opposite ends of a central portion, said front end portion and rear end portion configured as firm leaf springs such that any bending which occurs has virtually no influence on release characteristics of the binding means.

In accordance with still another aspect of the present invention there is provided a carrying plate for securing a ski boot on a ski, said carrying plate being rigid relative to a ski on which said plate is connected. The carrying plate comprises support means for supporting a boot holding means above the ski, said support means having a length extending in the longitudinal direction of the ski, said length being shorter than the length of a ski boot to be held on said boot holding means. The support means includes an inner fastening section connectable to a ski in a torsionally fixed manner with respect to all directions of the ski, and connectable to a ski in a generally non-compliant manner with respect to all directions relative to the ski, said inner fastening section having a forward end and a rearward end and forward and rearward fastening sections disposed at the forward and rearward ends of said inner fastening section, said forward and rearward fastening sections being connectable to the ski in a torsionally fixed manner with respect to all directions relative to the ski, and being connectable to the ski in a generally non-compliant manner in the transverse and vertical directions of the ski.

DETAILED DESCRIPTION

Figure 1:
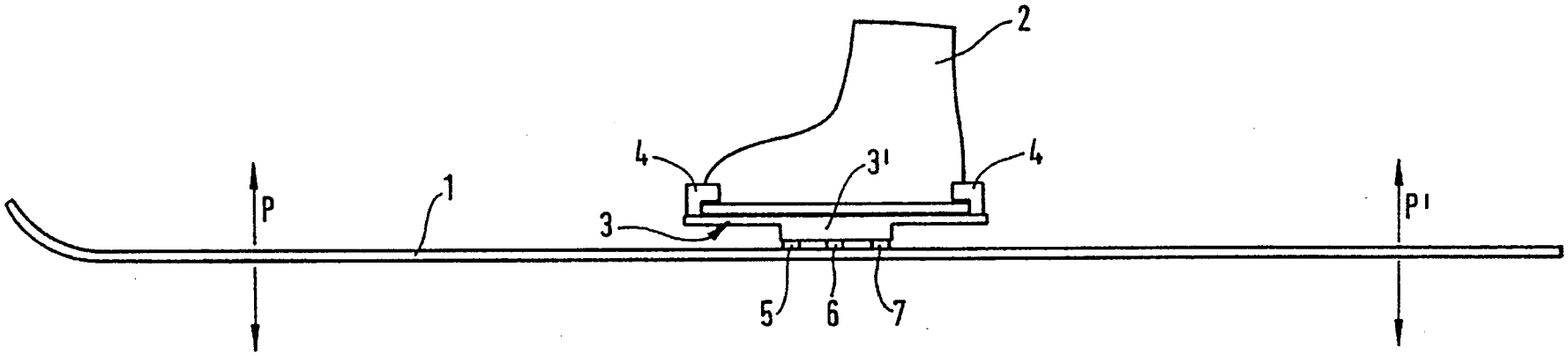
FIG. 1 shows a schematic side view of a ski with carrying plate according to the invention.

According to FIG. 1, arranged on the top side of a ski 1 in order to secure a ski boot 2 is a carrying plate 3 which is flexurally resistant or flexurally rigid in comparison with the ski 1 and on which the ski boot 2 can be fixed in a nonmovable manner to the greatest extent, for example by means of front and rear, releasable binding parts 4 at the forward and rearward parts of a boot holder on which the ski boot rests.

The carrying plate 3, which is moreover arranged at a vertical distance from the top side of the ski 1, has a region or support means 3' which is in the center in the example of FIG. 1 and by means of which the carrying plate 3 and binding parts 4 are supported on the ski 1. Said central region 3' is of short length in comparison with the ski boot 2 or the sole of the ski boot 2. The height of the central region 3' is dimensioned such that those parts of the carrying plate 3 which project forwards and rearwards beyond said region 3' do not come into contact with the top side of the ski 1 even if the ski 1 bends to a greater or lesser pronounced extent during skiing, for example in the case of bumps or swings.

Region 3' which is supported on the ski 1 is comprised of a forward fastening section, an inner fastening section and a rearward fastening section, and is respectively connected to the ski in three transverse-strip-like zones 5 to 7, such that region 3' of carrying plate 3 is connected to the ski 1 in a torsionally fixed manner with respect to the longitudinal, transverse and vertical axes of the ski and in a virtually non-compliant manner with respect to the transverse and vertical directions of the ski. In one of these zones, in particular within the central zone 6, the connection, furthermore, is configured such that there is (virtually) no compliance in the longitudinal direction of the ski. Within the other two zones 5 and 7, in contrast, there is compliance in the longitudinal direction of the ski, i.e., the top side of the ski can move in the longitudinal direction relative to that part of the supported region 3' which bears thereon. Apart from by a corresponding sliding fit, this can take place in that the corresponding connecting regions between ski 1 and supported region 3' exhibit, in the longitudinal direction of the ski, only a low, or fading, degree of resistance with respect to shear stresses.

Owing to the arrangement represented, region 3', which is supported on the ski 1 and is flexurally resistant and torsionally fixed to an extremely high degree, acts, on the one hand, via the zones 5 and 6, as an abutment for the front half, which can be sprung in the manner of a leaf spring, of the ski 1. On the other hand, the supported region 3' forms, via the zones 6 and 7, a corresponding abutment for the rear half, which is likewise sprung in the manner of a leaf spring, of the ski 1.

When forces act, in an upwards or downwards direction relative to the carrying plate 3, merely on the front half of the ski 1, corresponding to the double arrow P, then virtually only the front half of the ski 1 will move, in the direction of the double arrow P, relative to the carrying plate 3, whereas the rear half of the ski 1 tries to keep its position relative to the carrying plate 3 unchanged provided that this ski half is not, for its part, subjected to external forces.

Basically, the same applies for the rear half of the ski 1 when external forces occur there relative to the carrying plate 3, in the direction of the double arrow P'. In this case, the front ski half then tries to remain at rest relative to the carrying plate 3, provided that external forces do not likewise occur there.

The front end of the carrying plate 3 and the front half of the ski 1 thus form a V-type leg spring which is open to the front, whereas the rear end of the carrying plate 3 and the rear half of the ski 1 represent a corresponding V-shaped leg spring which is open to the rear. The two leg springs can be stressed and relieved of stress, to the greatest extent separately from one another.

For this purpose, it is important that both the front half of the ski 1 and the rear half thereof are connected to the region 3' of the carrying plate 3 in each case in two zones 5 and 6, and 6 and 7, respectively, which are located closely one behind the other in the longitudinal direction of the ski.

If, in contrast, the central connecting zone 6 were dropped and the ski 1 were movable, in this region, relative to the carrying plate 3 in the direction of vertical axis of the ski (vertical direction of the ski), then the portion of the ski 1 between the zones 5 and 7 could bend in the form of an arc if external forces acted, relative to the carrying plate 3, on the front ski half corresponding to the double arrow P or on the rear ski half corresponding to the double arrow P'. This would then inevitably result in, for example, an upwards movement, effected by external forces, of the front ski half relative to the carrying plate 3 also trying to force an—if somewhat weakened—upwards movement, relative to the carrying plate 3, onto the rear ski half.

Although, in the arrangement according to the invention, the front and rear ski halves can be sprung separately from one another to the greatest extent, even bending movements of the entire ski are not hindered by the carrying plate 3, or its region 3' which is supported on the ski, because, on the one had, the region 3' is of small dimension in the longitudinal direction of the ski and, on the other hand, there is sufficient capacity for longitudinal movement of the ski 1 relative to the carrying plate 3 outside one zone 6. The material expansions or compressions occurring, depending on the bending direction, within the ski, outside a neutral axis, are thus virtually not impaired at all, or are only slightly impaired, owing to the arrangement of the carrying plate 3.

The bending properties of the ski 1 overall thus remain unchanged in the case of the invention. Moreover, the front and rear ski halves can move in a sprung manner relative to the carrying plate 3, independently of one another to the greatest extent.

Figure 2:
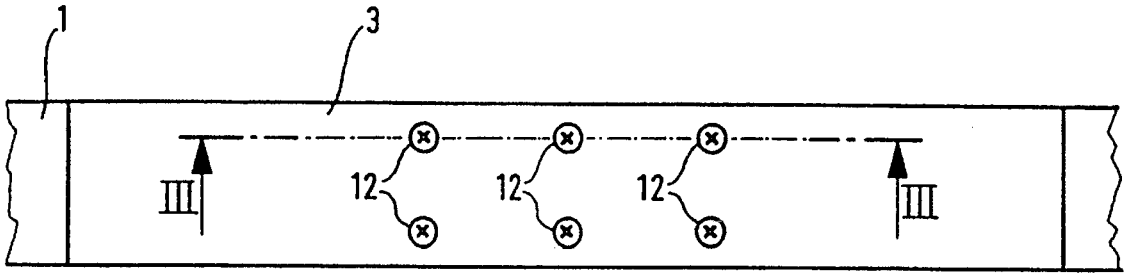
FIG. 2 shows a plan view of the carrying plate and the central region of a ski.
Figure 3:
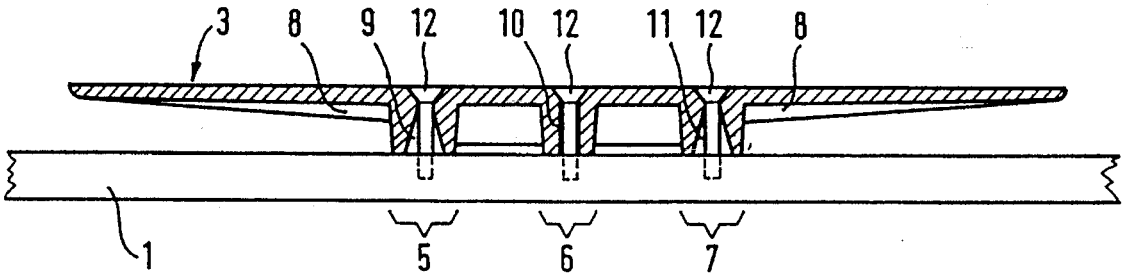
FIG. 3 shows a schematic vertical longitudinal section corresponding to the section line III—III in FIG. 2.
Figure 4:
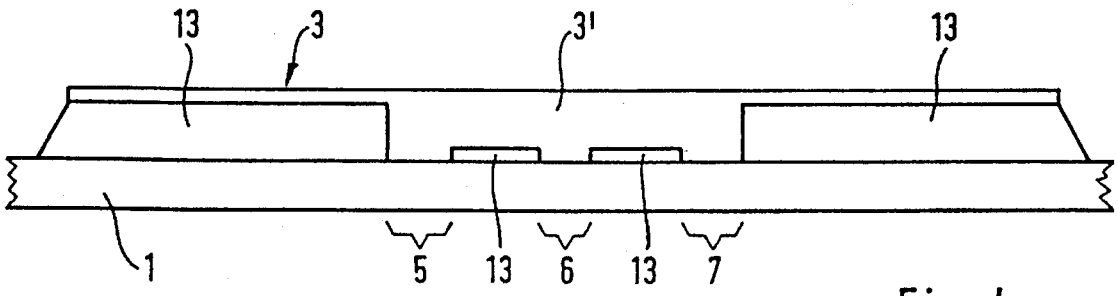
FIG. 4 shows a side view of ski and carrying plate, a damping elastomeric material being arranged between carrying plate and ski.

The carrying plate 3 represented in FIGS. 2 to 4 consists of a lightweight material which can be subjected to high loading, for example lightweight metal.

The top side of the carrying plate 3 is planar to the greatest extent, whereas, the underside, in particular in the longitudinal center region, may be reinforced by reinforcing ribs 8.

The region 3' which is supported on the ski 1 is essentially in the form of a box and can be configured as a hollow body or as a downwardly open housing and its interior can be reinforced by longitudinal and/or transverse ribs and transverse webs.

In the region of the transverse-strip-like zones 5 to 7, the supported region 3' has somewhat downwardly projecting transverse ribs which bear directly on the top side of the ski 1 and form a solid profile extending from the top side of the carrying plate 3 as far as the top side of the ski 1.

Within the transverse ribs provided in zones 5 to 7, there are arranged, in each case on both sides of the vertical longitudinal center plane of carrying plate 3, holes 9 to 11 for receiving fastening screws 12 which have been screwed, or are screwed, into the ski 1. The holes 9 to 11 have in each case essentially funnel-shaped (or also hemispherical) top regions for receiving the correspondingly shaped heads of the screws 12. Whereas the holes 10 then continue downwards as round holes which do not impart any radial play to the shank regions, which they receive, of the screws 12, the holes 9 and 11 form conical-like slots which, in plan view, extend parallel to the longitudinal axis of the ski 1. In the transverse direction of the ski, the holes 9 and 11, in their region beneath the screw heads, only have, however, a diameter which corresponds to the shank diameter of the screws 12. In other words, zones 5 and 7 of region 3' comprise transverse ribs forming orifices in the form of vertically extending holes 9 and 11. The upper portion of holes 9 and 11 are configured to receive heads of screw 12, while the lower portion of holes 9 and 11 being in the form of transverse slots which are dose to the shank at the head of the screw and which expand or widen longitudinally as the slot approaches the ski. Accordingly, the screws 12 in the holes 9 and 11 cannot move in the transverse direction of the ski, but can carry out movements, rocking in the longitudinal direction of the ski, with respect to the pivot-forming screw head.

All the screws 12 thus interact with the holes 9 to 11 to the effect that, relative to the region 3', which is supported on the ski of the carrying plate 3, the ski 1 is fixed in a non-compliant and torsionally fixed manner in the direction of the transverse axis of the ski and in the direction of the vertical axis of the ski. Furthermore, the ski 1 cannot, as a whole, be displaced in the longitudinal direction of the ski relative to the carrying plate 3 as a result of the screws 12 in the round holes 10; however, the top side of the ski in the region of the zones 5 and 7 at the holes 9 and 11, despite the screws 12 arranged there, can carry out movements in the longitudinal direction of the ski relative to the region 3' of the carrying plate 3.

Said longitudinal movements are not hindered by any adhesive connection or the like. Rather, said movements are to be facilitated by smooth contact faces between ski 1 and carrying plate 3 or the region 3' thereof.

Departing from the represented embodiment, the holes 9 and 11 may also be configured as slots in their top regions and in the region of the screw heads, with the result that in each case all the screws 12 in the holes 9 and 11 can be displaced in the longitudinal direction of the carrying plate 3.

According to a preferred embodiment of the invention, the supported region 3' of the carrying plate 3 rests within the zones 5 to 7—without an intermediate damping layer—on the top side of the ski 1. This ensures an unimpaired force flux between carrying plate 3 and ski.

Although the ends, which project forwards and rearwards beyond the region 3' of the carrying plate 3 are flexurally rigid to an extremely high degree, they can, if appropriate, yield in a manner of very firm leaf springs, but only to such a small extent that the binding parts 4 cannot effect movements of any great note relative to the sole of the ski boot 2 and the release characteristic of said binding parts 4 remains virtually unchanged and movements of the ski boot and shifts in weight of the skier relative to the ski 1 are transferred to the ski 1 in an unchanged manner to the greatest extent. In each case, the carrying plate 3 is thus considerably more rigid than the ski 1.

The spaces between the portions of the carrying plate 3 in front of and behind the region 3' and the top side of the ski can be outwardly closed off in order to avoid the penetration of snow and the formation of ice since, as a result of these, the capacity for free movement of the ski 1 relative to the carrying plate 3 could be hindered.

For this purpose, the spaces may be filled with a foam-like, compliant material. In the case of correspondingly pronounced compliance, there is virtually no damping of the movements of the ski 1.

In a corresponding manner, the spaces between the underside of the region 3' of the carrying plate 3 and the top side of the ski—between the zones 5 to 7—may be closed off by a filling material.

In principle, it is also possible to arrange a damping filling material 13, such as rubber or another elastomeric material, between carrying plate 3 and ski 1, in front of, and behind the supported region 3'. Said filling material may comprise a plurality of different layers.

This can, furthermore, also fill the spaces between the region 3' and the top side of the ski. By a corresponding, if appropriate different, choice of material, the front half of the ski and the rear half of the ski can be damped to a greater or lesser extent.

Departing from the represented embodiment, the carrying plate 3 does not have to be arranged such that it can be separated from the ski 1. If appropriate, the region 3' of the carrying plate 3 can be integrated, in the region of the zones 5 to 7 (see FIG. 1), into the structure of the ski 1. However, these zones 5 to 7 are to be configured, in turn, such that relative movements between carrying plate 3 and ski 1 in the transverse and longitudinal directions of the ski and relative pivoting between ski 1 and carrying plate 3—in particular with respect to; the vertical axis of the ski—are prevented. Furthermore, one of the zones 5 to 7 is then also to be non-compliant in the longitudinal direction of the ski, whereas the other two zones are compliant in the longitudinal direction of the ski with respect to shear stresses.

The present invention has been described with reference to a preferred embodiment. Other modifications and alterations will occur to those skilled in the art upon a reading and understanding of the present specification. It is intended that all such modifications and alterations be included insofar as they come within the scope of the appended claims or equivalents thereof.

What is claimed is:

1. A carrying plate for securing a ski boot on a ski, wherein said carrying plate is rigid relative to the ski, said carrying plate comprising:

a central portion for supporting a boot holding means above the ski and for connecting said carrying plate to said ski, said central portion extending in the longitudinal direction of the ski and having a length shorter than the ski boot to be held on said boot holding means, said central portion comprising:

forward and rearward fastening sections; and an inner fastening section between said forward and rearward fastening sections;

wherein said forward and rearward fastening sections and said inner fastening section are connectable by fasteners extendible through openings in said fastening sections to a top side of the ski, the openings in the forward and rearward fastening sections extending downwardly and diverging in a downward direction, the central portion being connected in a torsionally fixed manner with respect to the longitudinal, transverse and vertical axes of the ski and in a generally non-compliant manner in the transverse and vertical directions of the ski, wherein the ski is prevented from bending in the transverse and vertical directions, said forward and rearward fastening sections being connectable to the ski in a compliant manner in the longitudinal direction of the ski, and said inner fastening section is connectable to said ski in a generally non-compliant manner in the longitudinal direction of the ski.

2. The carrying plate of claim 1, wherein said central portion is located approximately in the longitudinal center of said carrying plate.

3. The carrying plate of claim 1, wherein said inner fastening section is connectable to said ski at approximately the longitudinal center of the ski.

4. The carrying plate of claim 1, wherein said inner fastening section is located approximately in the longitudinal center of said central portion.

5. The carrying plate of claim 1, wherein said forward and rearward fastening sections are connectable to said ski in the form of a sliding fit which is compliant in the longitudinal direction of the ski.

6. The carrying plate of claim 1, wherein said central portion is connectable to said ski in a virtually undamped manner.

7. The carrying plate of claim 1, wherein said forward and rearward fastening sections and said inner fastening section are comprised of rib-like transverse strips.

8. The carrying plate of claim 7, wherein said rib-like transverse strips are integrally formed on the underside of the central portion and are directed towards the top side of said ski.

9. The carrying plate of claim 1, wherein the length of said central portion is approximately two to three times the width of the ski.

10. The carrying plate of claim 1, wherein said central portion is of a width which corresponds approximately to the width of the ski.

11. The carrying plate of claim 1, wherein said central portion is supported on the ski and is flexurally resistant and torsionally fixed.

12. The carrying plate of claim 1, wherein said carrying plate further comprises:

a front end portion and a rear end portion extending outward longitudinally from opposite ends of said central portion, said front end portion and rear end portion configured as firm leaf springs such that any bending which occurs has virtually no influence on release characteristics of said binding means.

13. The carrying plate of claim 12, wherein the spring rate of the front end portion and the rear end portion is considerably greater than the spring rate of that portion of the ski which is overlapped respectively by the front end portion and the rear end portion.

14. The carrying plate of claim 1, wherein the carrying plate has a front end portion and a rear end portion spaced above the top side of the ski, the space between the front end portion and the surface of the ski, the space between the rear end portion and the surface of the ski, and the space between the lower surface of the central portion and the surface of the ski being enclosed to prevent the penetration of snow and the formation of ice.

15. The carrying plate of claim 14, wherein compliant filling material encloses said spaces.

16. The carrying plate of claim 15, wherein said compliant filling material is a damping material.

17. The carrying plate of claim 1, wherein the openings in said forward and rearward fastening sections and said inner fastening section each comprise:

a plurality of holes arranged in a row transverse to the longitudinal direction of the carrying plate for receiving fasteners for connecting said carrying plate to said ski, said fasteners being non-movable in the transverse direction of the ski.

18. The carrying plate of claim 17 wherein said plurality of holes associated with said inner fastening section secure said fasteners non-movably in the longitudinal direction of the ski.

19. The carrying plate of claim 17, wherein said fasteners are screws.

20. The carrying plate of claim 18, wherein said plurality of holes associated with said forward and rearward fastening sections are configured as slots having a diameter corresponding to the shank diameter of the fasteners in the transverse direction of the ski.

21. The carrying plate of claim 20, wherein said plurality of holes associated with said forward and rearward fastening sections each have an upper region in the form of a round hole for receiving the head of a screw and a lower region which forms a slot which widens longitudinally as the slot approaches the ski.

22. The carrying plate of claim 1, wherein said carrying plate is constructed of lightweight metal.

23. The carrying plate of claim 1, wherein said carrying plate is constructed of high-strength plastic.

24. The carrying plate of claim 1, wherein said central portion is integrally connected to the ski, said central portion being torsionally fixed in at least three zones which are located one beside the other in the longitudinal direction of the ski, being non-compliant in the transverse and vertical directions of the ski, and being non-compliant in the longitudinal direction of the ski in one of said at least three zones.

25. A carrying plate for securing a ski boot on a ski, said carrying plate being rigid relative to a ski on which said plate is connected, said carrying plate comprising:

support means for supporting a boot holding means above the ski, said support means having a length extending in the longitudinal direction of the ski, said length being shorter than the length of a ski boot to be held on said boot holding means, said support means including:

an inner fastening section connectable to the ski in a torsionally fixed manner with respect to all directions of the ski, and connectable to the ski in a generally non-compliant manner with respect to all directions relative to the ski, said inner fastening section having a forward end and rearward end; and forward and rearward fastening sections disposed at the forward and rearward ends of said inner fastening section, and being connectable to ski in a torsionally fixed manner with respect to all directions relative to the ski; and being connectable to the ski in a generally non-compliant manner in the transverse and vertical directions of the ski, and being connectable to the ski in a compliant manner in the longitudinal direction of the ski, said forward and rearward fastening sections having openings extending downwardly and diverging in a downward direction for receiving ski-connecting fasteners, the forward and rearward fastening secions being compliant in the longitudinal direction of the ski.

* * * * *